US008007892B2

(12) United States Patent
Tuma

(10) Patent No.: US 8,007,892 B2
(45) Date of Patent: Aug. 30, 2011

(54) TOUCH FASTENER

(75) Inventor: Jan Tuma, Herrenberg-Mönchberg (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 189 days.

(21) Appl. No.: 12/225,421

(22) PCT Filed: Apr. 24, 2007

(86) PCT No.: PCT/EP2007/003579

§ 371 (c)(1),
(2), (4) Date: Sep. 22, 2008

(87) PCT Pub. No.: WO2007/134685

PCT Pub. Date: Nov. 29, 2007

(65) Prior Publication Data

US 2009/0126166 A1 May 21, 2009

(30) Foreign Application Priority Data

May 23, 2006 (DE) ..... 10 2006 024 014

(51) Int. Cl.
*A44B 18/00* (2006.01)

(52) U.S. Cl. ..... 428/99; 24/442; 24/452

(58) Field of Classification Search ..... 428/99; 24/442, 452
See application file for complete search history.

(56) References Cited

U.S. PATENT DOCUMENTS

2003/0126724 A1 7/2003 Kono et al.

FOREIGN PATENT DOCUMENTS

| | | | |
|---|---|---|---|
| DE | 196 46 318 | A1 | 5/1998 |
| DE | 102 23 234 | B4 | 12/2002 |
| EP | 0 705 064 | B1 | 5/2001 |
| GB | 2 279 106 | A | 12/1994 |
| WO | WO 01/43684 | A1 | 6/2001 |
| WO | WO 01/49776 | A2 | 7/2001 |
| WO | WO 03/099951 | A2 | 12/2003 |
| WO | WO 2004/105536 | A1 | 12/2004 |

*Primary Examiner* — Alexander Thomas
(74) *Attorney, Agent, or Firm* — Roylance, Abrams, Berdo & Goodman, LLP

(57) ABSTRACT

A touch fastener has a plurality of interspaced bonding elements arranged on a backing. Each element has a head (12) connected to the backing by a stem (14). To allow the head (12) to always remain fastened to a body in the immediate vicinity, even if the backing is axially displaced over a predeterminable distance on a plane extending parallel to the body, the head (12) has a disc with a diameter greater than the diameter at any point on the stem (14). The stem is conical and connected to the disk in an articulated manner by an articulated part (16).

16 Claims, 2 Drawing Sheets

TOUCH FASTENER

FIELD OF THE INVENTION

The invention relates to a touch fastener having a plurality of bonding elements spaced relative to one another, located on a backing, and having a head connected to the backing by a stem.

BACKGROUND OF THE INVENTION

DO 2004/105536 A1 discloses a touch fastener in which the free ends of the stems of the individual bonding elements are provided with a plurality of individual fibers. The diameter of the respective fibers is chosen to be very thin so that on the free end of each individual fiber only a very small contact surface ranging from 0.2 to 0.5 μm is available.

These orders of magnitude, which in preferred embodiments can also be in the nanometer range, enable interaction with a corresponding body in the vicinity on which the touch fastener is to be attached, by van-der-Waals forces classically regarded as a subgroup of adhesion. The conventional touch fastener has good connection properties, but is tied to a correspondingly costly production process.

This problem also applies to a touch fastener according to publication WO 01/49776 A2 which provides indications to one skilled in the art to use parts of the foot structure of a gecko directly as biological material, or to artificially imitate it. This adhesive structure has a plurality of spatulae components with each divided into a plurality of individual filaments in the form of a bent cylindrical fastener element on the free end.

Conversely, for simplified production, DE 102 23 234 B4 proposed a method for surface modification of an object, in the form of a fastener part with the objective of increasing the adhesion capacity of the bonding element. For this purpose, the free surface is subjected to structuring to form a plurality of projections, with each provided with a foot part and a head part. The head part has a face surface oriented away from the surface. Each projection is formed with a size such that all face surfaces have the same vertical height over the surface. This arrangement yields an adherent contact surface interrupted by mutual distances between the face surfaces. The foot parts of the projections are tilted relative to the surface normals of the surface.

It is possible with this known solution to make available the implementation of detachable bonding connections for an extended range of materials, with increased adhesion capacity and the possibility of enabling the setting of predetermined adhesion forces or properties. However, based on the relatively rigid arrangement between the head and backing by the optionally tilted stems, there is still opportunity for improved solutions.

SUMMARY OF THE INVENTION

An object of the invention is to provide an improved touch fastener with improved adherence and fastening action with the simultaneous possibility of being able to produce these systems economically and reliably.

This object is basically achieved by a touch where the head has a head plate with the diameter greater than the diameter at any point of the stem and where the stem is conical and linked to the head plate by an articulation part. The result is that the head in each instance remains adhering to a body in the vicinity, even if the backing should be displaced axially in the plane-parallel direction to this body by a predefinable amount. As a result of coupling by articulation parts, the stems can tilt in the oblique direction within a predefinable framework, without this adversely affecting the coupling of the head relative to the body in the vicinity. Since the head with the head plate can have a very large diameter, the possibility of adhering to the body in the vicinity is improved.

In particular, when vibrations occur in which the backing executes short-stroke vibrations relative to the body in the vicinity, the touch fastener according to the invention is an especially good connection solution. The coupling improved in this way even prevails when the respective stem relative to the head from the outset assumes a predefinable alignment in the form of a tilt relative to the vertical.

Due to the conical arrangement of the stem elements widening in the direction of the backing, an independent component need not be formed for the articulation site. Rather, the articulation site can be formed due to the direct transition of the conically tapering tip of the stem or its end into the head. Since the respective stem thus has its greatest diameter in the region of the transition to the backing, in the direction of the tapering stem end the intermediate space between adjacent bonding elements is increased. At this site, increased distribution space or embedding space for the heads with their head plates is then available. In this way the diameter ranges for the heads can be dramatically increased, unhindered by the remaining stem structure so that improved adhesion over an enlarged contact surface is achieved. This structure also results in reliable operation of the touch fastener which can be repeatedly detached. Furthermore, the arrangement according to the invention can be economically produced in large numbers.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure and which are schematic and not to scale.

DETAILED DESCRIPTION OF THE INVENTION

The orders of magnitude addressed with the touch fastener should suffice in the geometrical implementation and are designed such that interaction with a corresponding part, whether in the form of another touch fastener, or in the form of the surface of a body in the vicinity on which the touch fastener according to the invention is to be fixed, can preferably take place by van-der-Waals forces. These van-der-Waals forces constitute a subgroup of adhesion and are formed because the negatively charged electrons swirling around the positive nucleus in an atom are briefly concentrated on one side. For this reason, the atom on this side is temporarily negatively charged, while on the other side conversely it is positively charged. This charging also influences adjacent atoms. In this case, the atoms along the top of the support surface of the head cause the support surface of the head, depending on which charge it receives, to be attracted either by the positive atoms or the negative atoms of the respective opposite surface of the body in the vicinity.

The larger the resulting contact surfaces are in total, the stronger the forces which arise. The resulting large-dimensioned head support surfaces arising as a result of the conically tapering stem ends are then favorable for achieving strong van-der-Waals forces. Although the van-der-Waals forces are among the weakest forces in nature, the effect is sufficient to achieve relatively high fastening forces, especially considering that several thousand bonding elements can be on the extremely small space of the backing. If the surface of the respective head should be chemically modified in a corresponding manner, a true chemical bond as the adhesion connection is conceivable.

Figure 1:
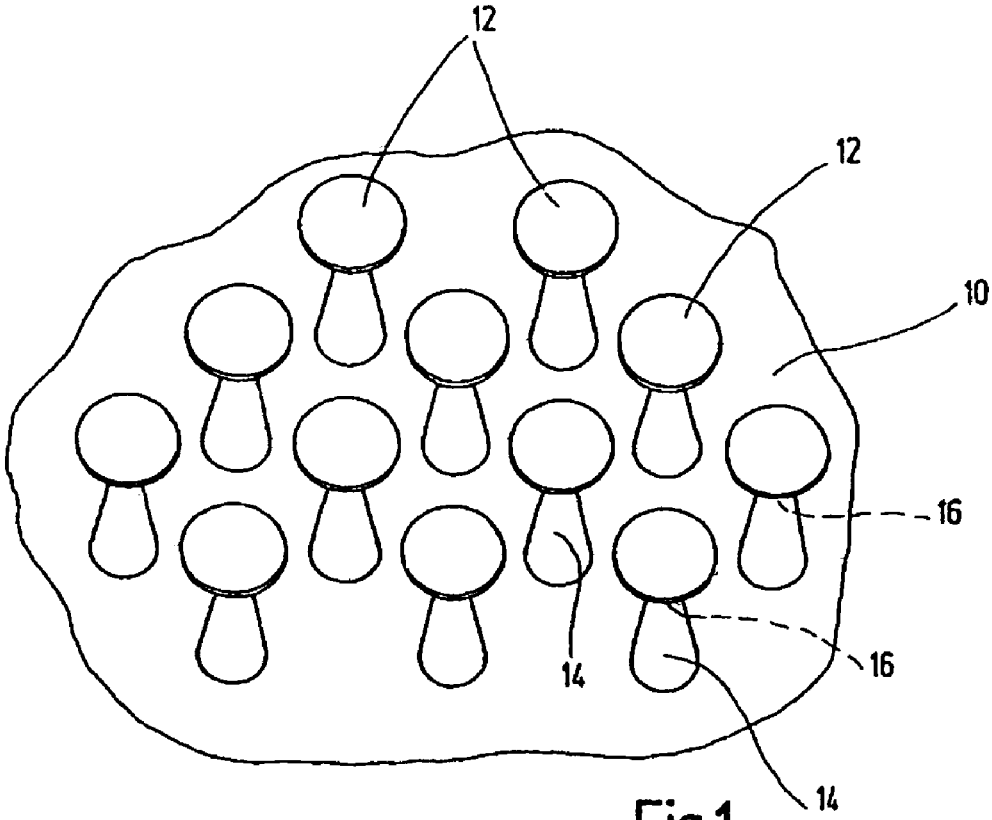
FIG. 1 is a perspective view of an extract from a touch fastener with a plurality of bonding elements according to a first exemplary embodiment according to the present invention.

The touch fastener shown in FIG. 1, for the purposes of this invention, can be obtained, for example, according to a microreplication process described in DE 196 46 318 A1. The prior art process is used to produce a touch fastener with a plurality of interlocking means or elements made in one piece with the backing 10 in the form of stems 14 having heads 12. Preferably, a thermoplastic in the plastic or liquid state is delivered to the gap between a compression roll and a shaping roll. The shaping roll is provided with a screen with cavities open to the interior and the exterior. The two rolls for the production process are driven in opposite directions so that the backing material is formed in the gap between the rolls with the formation of the backing 10. Since the touch fastener according to the invention has stems 14 made conical, the screen cross section is matched to the exterior contour of the respective support stem 14. In particular, the screen cross section uniformly tapers conically in the direction of the interior of the roll.

Figure 3:
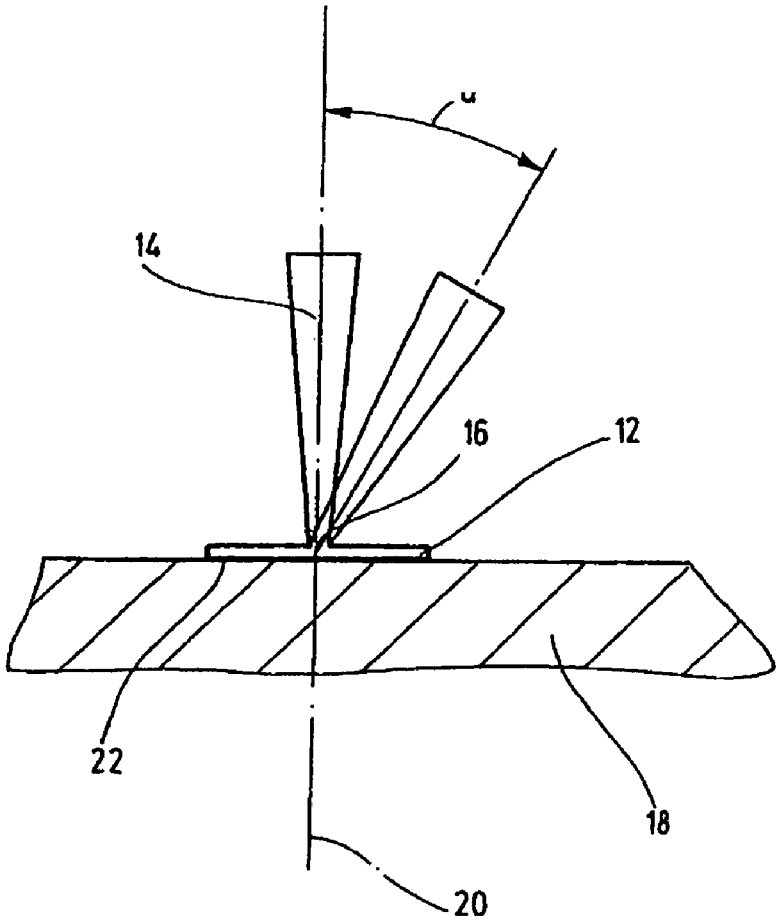
FIG. 3 is a side elevational view in section of an individual bonding element of FIG. 1 in a vertical alignment and in an oblique arrangement without the backing.

Another possibility for obtaining the fastener system shown in the figures is described in DE 100 65 819 C1. In this known method for producing touch fasteners, a backing material in at least one partial region of its surface is provided with touch fastener elements or bonding elements projecting from its plane. A plastic material forming the fastener elements is applied to the backing element providing the backing 10. The elements are made without a shaping tool at least in one partial region in which the plastic material is deposited by at least one application device in successively delivered droplets. Although the application device yields plastic material with a droplet volume of only a few picoliters via its nozzle, a high-speed process can be implemented such that a touch fastener as shown in FIG. 1 is obtained in an extremely short period of time. This method also makes it possible, in particular, to produce individual bonding elements as shown in FIG. 3 where each has a head 12 and a conical stem 14 with an articulation site on part 16. In turn, these bonding elements can then be applied in a plurality of backings 10 of any form, for example, by cementing or melting on. This backing 10 then need not have a configuration extending flat, but may definitely follow curved paths with convex or concave radii (not shown).

Another option for producing the touch fastener according to the invention may involve a thin plastic film being applied, for example, doctored on, onto the free tapering stem end 14 and then to clip it, for example, by a laser, to obtain the desired geometry of the respective head 12. Films can also be applied in this way for the backing 10.

The backing 10 as well as the heads 12 and the tapering stems 14 with integrated articulation coupling are formed preferably of a plastic material chosen in particular from the group of acrylates such as polymethacrylates, polyethylenes, polypropylenes, polyoxymethylenes, polyvinylidene fluoride, polymethylpentene, poly(ethylene)-chlorotrifluoroethylene, polyvinyl chloride, polyethylene oxide, polyethylene terephthalate, polybutylene terephthalate, nylon 6, nylon 6.6, and polybutene.

Essentially, plastics with long chains of molecules and good orientation behavior, as well as plastic materials with thixotropic behavior can be used especially effectively. Thixotropic behavior for the purposes of the invention in this connection is to denote the reduction of structural thickness during the shear loading phase and its more or less a prompt but complete restoration during the following rest phase. This breakdown/restoration cycle is a completely reversible process, and thixotropic behavior can be defined as a time-dependent behavior.

Furthermore, plastic materials have proven favorable in which the viscosity measured with a rotational viscosimeter ranges from 7,000 to 15,000 mPas. Preferably, it has a value of approx. 10,000 mPas at a shear rate of 10 l/sec. For the purposes of a self-cleaning surface, it has proven favorable to use plastic materials whose contact angle has at least a value of greater than 60 degrees as a result of its surface energy for wetting with water. Under certain circumstances, this surface energy can be further changed by subsequent treatment processes.

With respect to the aforementioned requirements, an especially interesting representative of suitable plastic materials is polyvinyl siloxane. The use of this plastic can be provided in particular for forming the heads 12 and their free surface side.

For the sake of clarity, the individual bonding elements in FIG. 1 are shown arranged spaced relatively far apart from one another. In reality, these bonding elements including of the stem 14, articulation site or part 16, and head 12 lie tightly against one another. Thus 10,000 to 20,000 of these elements per square centimeter can be located on the homogenous backing 10. A uniform arrangement is preferred in which all bonding elements have the same distance to one another. Irregular arrangements or those in pattern form (circular, stem-shaped, ellipsoidal, etc.) are also possible.

The heads 12 which are disc-shaped in exterior contour can also have other shapes. For example, the heads can be made elliptical or in polygonal form. A hexagonal form has been found to be especially favorable, also relative to the screen shaping process. The same applies to the stems 14. The conicity for the respective stem 14 is at least one degree of oblique tilt relative to horizontal. Preferably, the conicity is approx. 2.5 to 5 degrees to be able to obtain slender stem elements. The articulation site 16, shown in FIG. 2, has a diameter from approx. 1 to 5 μm, preferably 2 μm, this diameter range being shown in FIG. 2 as Z2.

Figure 2:
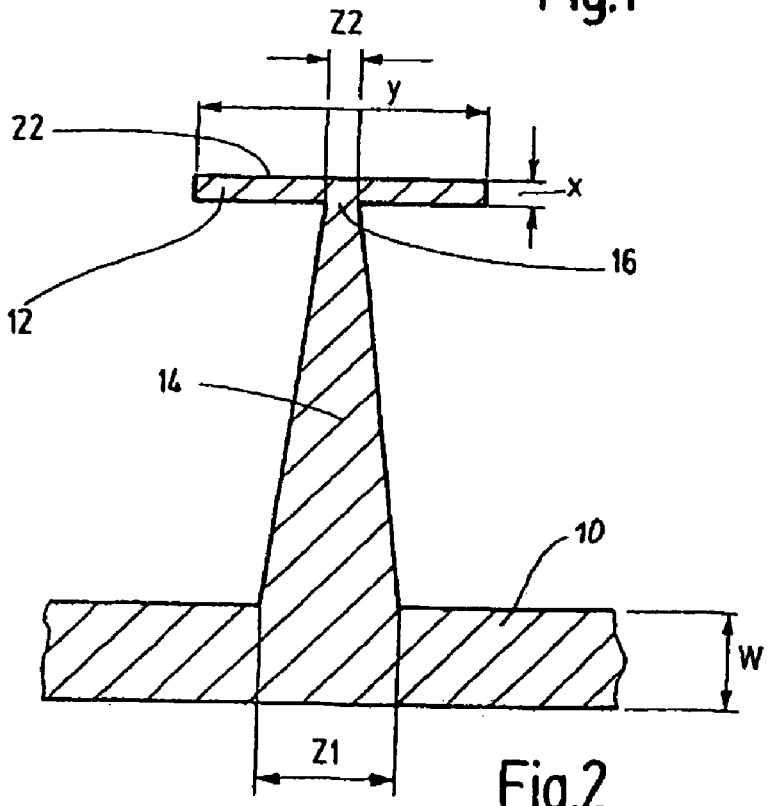
FIG. 2 is a side elevational view in section of an individual bonding element of FIG. 1.

In the embodiment shown in FIG. 2, the conical stem 14 as a molded part is connected in one piece to the backing 10. The connection of the stem 14 to the backing 10 can also be produced via a cement connection (not shown) in the same size range. The thickness of the backing 10 is shown in FIG. 2 with the opposing arrows W and in terms of magnitude corresponds to the indicated size Z2. In particular, when the bonding element as shown in FIG. 3 is produced without backing 10 and is connected to it only later, for example, by a cement or melt connection method, the backing 10 can also be made larger in terms of the thickness W. On its end facing away from the articulation site 16, the conical stem has a thickness Z1 from 5 to 25 μm, preferably from approx. 10 to 20 μm. The diameter Y of the head 12 is in turn, depending on the stem geometry, 30 to 100 μm, preferably approx. 40 μm. The head 12 in terms of its thickness X is chosen to be exceptionally narrow-lipped, and the values can be <1 μm. For an embodiment (not shown) originating from the transition region of the head 12 to the stem 14, the head tapers to the exterior in terms of width and ends in an annular end edge. Especially high holding forces for the head 12 can be expected for the narrow-lipped feature tapering in this way.

The purpose of FIG. 3 is to illustrate in particular a detachment of the head 12 as a peeling motion from the body 18 in the vicinity. When the stem 14 is tilted around the articulation part by an angle a of approx. 20° relative to the vertical 20, the peeling motion takes place, i.e., the edge of the head 12 which is the left edge as viewed in FIG. 3 begins to detach over the contact surface 22 of the head 12 as a rolling motion. Depending on the concept of the touch fastening element, this angle a can also be more than 20°, in particular at least 40°. If in the initial state the stem 14 is not located parallel to the vertical 20, but rather, extends obliquely, the stem already assumes a starting angle a, that is, the tapered end of the stem 14 ends in an oblique arrangement on the otherwise flat head plate of the head 12. For a detachment motion in turn a corresponding angle offset can be expected which is then lower this time than for a vertical arrangement of the stems 14 relative to the head plate of the head 12.

Figure 4:
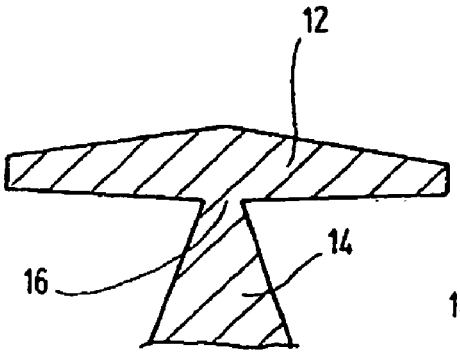
FIG. 4 is a partial side elevational view in section of an individual bonding element according to a second exemplary embodiment of the present invention.
Figure 5:
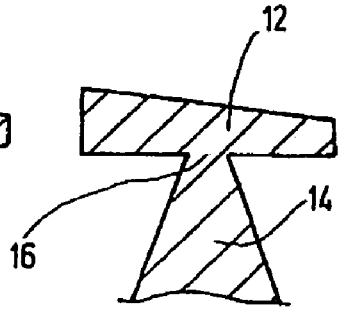
FIG. 5 is a partial side elevational view in section of an individual bonding element according to a third exemplary embodiment of the present invention.
Figure 6:
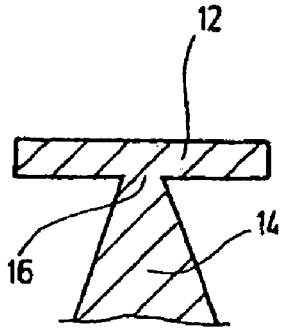
FIG. 6 is a partial side elevational view in section of an individual bonding element according to a fourth exemplary embodiment of the present invention.

As shown, the head plate can be made flat and accordingly can have essentially a uniform thickness. Other cross sectional shapes on head plates can be implemented within the framework of the solution according to the invention. In another embodiment, as shown in FIG. 4, the head plate viewed in cross section is made as a double wedge shape, i.e., proceeding from the middle in the region of the stem 14 the head plate narrows to both sides, along bevels tapering away from one another. In the embodiment as shown in FIG. 5, a single wedge is formed with one side having the greatest thickness and the opposite side having the smallest thickness. In the illustrated embodiment only the top is tilted. The top and underside can also taper toward one another to form a wedge. In the embodiment as shown in FIG. 6, in contrast to the above described solutions, the stem 14 is arranged off-center on the underside of the head plate of the head 12. The head forms a plate made flat. Instead of the head plate made flat, in the embodiment as shown in FIG. 6, it can also have other shapes, in particular the wedge cross sectional shapes as shown in FIGS. 4 and 5. If a tilted wedge shape is used for the head plate, the oblique surfaces are tilted between 5° to 15°, preferably by 10°. Depending on the peeling direction, the associated angle a can then be set, in particular, can be enlarged. The sharp-edged transitions shown in the figures between the backing band, the stem 14 and the head 12 are preferably round, in particular at the transition between the underside of head 12 and stem 14. The radial outside edges of the head 12, at least partially, can likewise be provided with the corresponding rounding to simplify production.

While various embodiments have been chosen to illustrate the invention, it will be understood by those skilled in the art that various changes and modifications can be made therein without departing from the scope of the invention as defined in the appended claims.

What is claimed is:

1. A touch fastener and an adjacent body, comprising:

a backing;

a plurality of bonding elements spaced relative to one another and located on said backing, each said bonding element having a head connected to a stem in turn connected to said backing, each said head having a head plate with a diameter greater than diameters of the respective stem at any point along the respective stem, each said stem being conical and being linked to the respective head plate by an articulation part; and a contact surface on each said head plate being detachably adherable to the adjacent body by an adhesion force.

2. A touch fastener according to claim 1 wherein said head plate has a uniform thickness.

3. A touch fastener according to claim 1 wherein said head plate has a wedge shape in cross section.

4. A touch fastener according to claim 3 wherein said head plate has a double wedge shape.

5. A touch fastener according to claim 1 wherein said head plate has a curved outer periphery.

6. A touch fastener according to claim 5 wherein said curved outer periphery extends along a circular path.

7. A touch fastener according to claim 1 wherein said head plate has a polygonal outer periphery.

8. A touch fastener according to claim 7 wherein said polygonal outer periphery is hexagonal.

9. A touch fastener according to claim 1 wherein said backing is integrally connected to said bonding elements.

10. A touch fastener according to claim 9 wherein each said head is detachable in a peeling motion from the adjacent body when said stem connected thereto is tilted about the respective articulation part by an angle of at least twenty degrees relative to a vertical.

11. A touch fastener according to claim 10 wherein the angle is at least forty degrees.

12. A touch fastener according to claim 1 wherein said heads are essentially vertically upright on said stems in an initial state.

13. A touch fastener according to claim 1 wherein said bonding elements comprise micro-replication plastic material.

14. A touch fastener according to claim 1 wherein said contact surfaces of said heads comprise polyvinyl siloxane.

15. A touch fastener according to claim 1 wherein each said stem is off-center relative to the respective head.

16. A touch fastener element for a touch fastener and an adjacent body, comprising a conically tapered stem;

a head connected by an articulation part to a smaller end of said stem, said head being a flat head plate and having a greater diameter than diameters of said stem along at any point along said stem; and a contact surface on said head plate being detachably adherable to the adjacent body by an adhesion force.

* * * * *